United States Patent [19]

Auer

[11] 4,083,131

[45] Apr. 11, 1978

[54] APPARATUS FOR REGENERATION OF SKIING COURSES

[76] Inventor: Max Auer, 18 Agathafeld, Rossruti, Wil(Kt.St. Gallen), Switzerland

[21] Appl. No.: 782,350

[22] Filed: Mar. 29, 1977

[30] Foreign Application Priority Data

Apr. 2, 1976 Switzerland ..... 4133/76

[51] Int. Cl.[2] ..... E01C 19/00

[52] U.S. Cl. ..... 37/13; 172/392; 172/630; 172/767; 280/12 R

[58] Field of Search ..... 37/41, 10, 13; 172/280, 172/786, 787, 767, 188, 199, 393, 392, 387, 623, 624, 630, 631, 145–146; 280/12 R, 12 A

[56] References Cited

U.S. PATENT DOCUMENTS

| | | | |
|---|---|---|---|
| 882,751 | 3/1908 | Edwards | 172/387 |
| 932,785 | 8/1909 | King | 172/392 |
| 970,966 | 9/1910 | Spicer | 172/199 X |
| 1,968,412 | 7/1934 | Lull | 172/387 |
| 3,656,557 | 4/1972 | Eskelson | 172/277 |
| 3,872,931 | 3/1975 | Camp | 172/387 |
| 3,878,900 | 4/1975 | Boisse et al. | 172/145 |
| 3,915,239 | 10/1975 | Hendrichon | 172/146 |
| 4,014,116 | 3/1977 | Baechler | 172/393 |
| 4,019,268 | 4/1977 | Waterman | 37/10 |

FOREIGN PATENT DOCUMENTS

| | | | |
|---|---|---|---|
| 118,751 | 8/1944 | Australia | 172/387 |
| 1,261,209 | 1/1972 | United Kingdom | 172/393 |

*Primary Examiner*—E.H. Eickholt
*Attorney, Agent, or Firm*—William Anthony Drucker

[57] ABSTRACT

A method for preparing and regenerating skiing courses wherein the snow is broken up, crumbled and deep-frozen in loosened condition and then a hard course covering is produced by fine levelling and smoothing.

An apparatus for carrying out the method comprises a frame mounted on runners and carrying planing bodies which can be adjusted to one position to dig into and break up the snow and to a second position to level and smooth the top surface of the broken up snow.

12 Claims, 9 Drawing Figures

APPARATUS FOR REGENERATION OF SKIING COURSES

Figure 1:
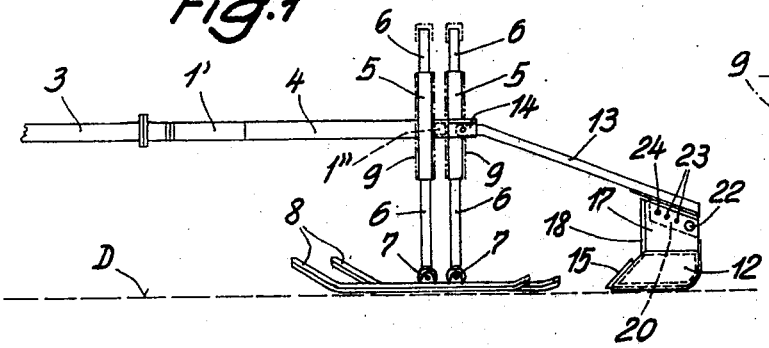

The present invention relates to a method and an apparatus for the preparation and regeneration of skiing courses.

The action of known equipment for the treatment of skiing courses and race tracks for alpine ski racing is confined to the levelling, smoothing and pressing of the blanket of snow. However, it is not possible to provide permanent courses on blankets of fresh or powder snow by means of this known equipment. Skiing courses produced on loose blankets of snow do indeed have a smooth and hard covering layer, but when subjected to high stresses, such as occur in ski racing, they will break in places, due to the powder or fresh snow lying underneath the hard course covering, there being thus formed uneven areas which are dangerous for the skier or racer.

The present invention aims at remedying this unsatisfactory state of affairs.

As proposed by the method according to the invention, the blanket of snow is broken up in a thickness which is several times that of the course hard layer to be produced, is crumbled and is deep-frozen in this loosened condition by the penetration of cold environmental air in the entire loosened area, and subsequently the hard course covering is produced by means of fine levelling and smoothing.

The invention furthermore relates to an apparatus for the performance of the method, in which apparatus a draw mounting frame is arranged, so as to be adjustable in height by means of slides, on supports comprising runners which are swingably hinged to the lower ends of the latter and several planning bodies, which are arranged side by side, are hinged to the draw mounting frame so as to be swingable by means of draw rods; the entire arrangement being such that by lowering of the draw mounting frame by means of hydraulic driving elements the planing bodies are moved from their horizontal sliding position to a steep position, so that they penetrate into the blanket of snow in the manner of a plough share and, while travelling, cause the same to be continuously ripped up.

Figure 2:
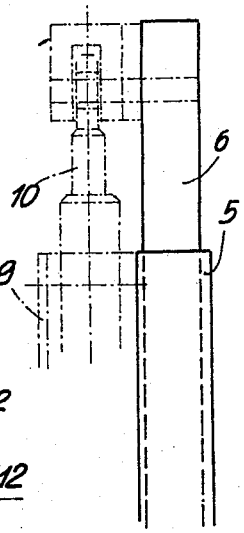
Figure 3:
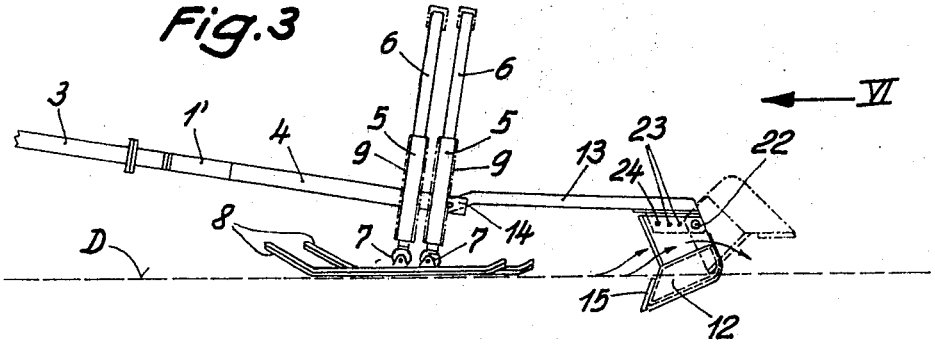
Figure 4:
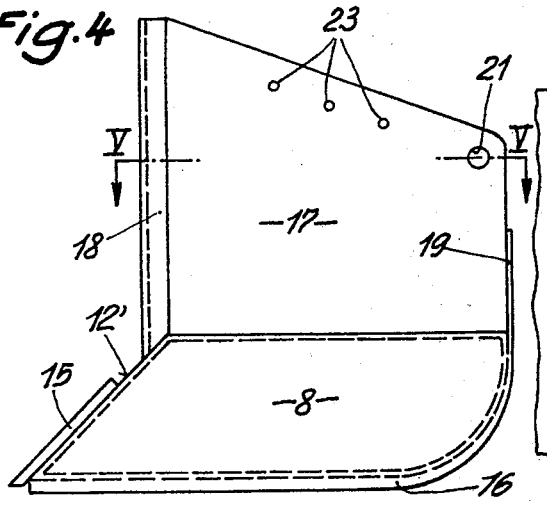
Figure 5:
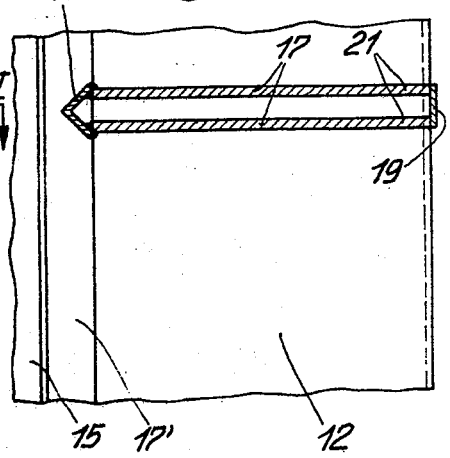
Figure 6:
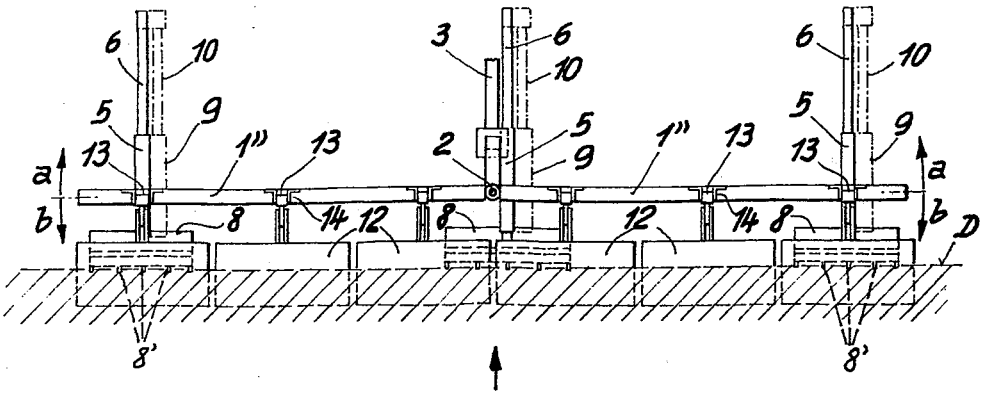
Figure 7:
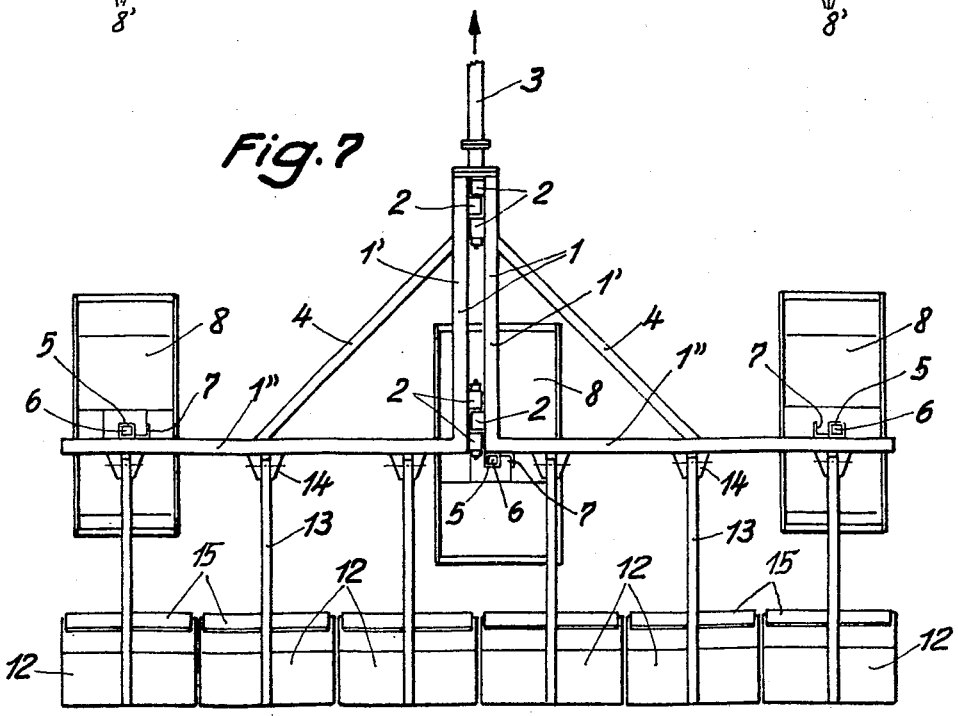
Figure 8:
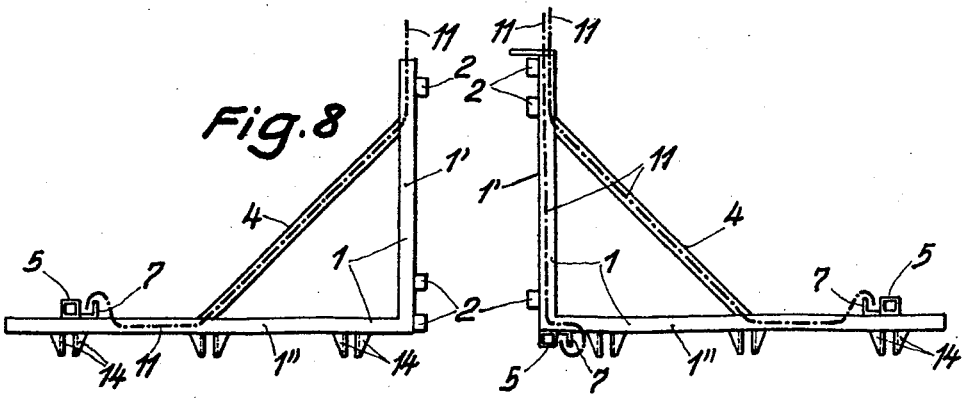
Figure 9:
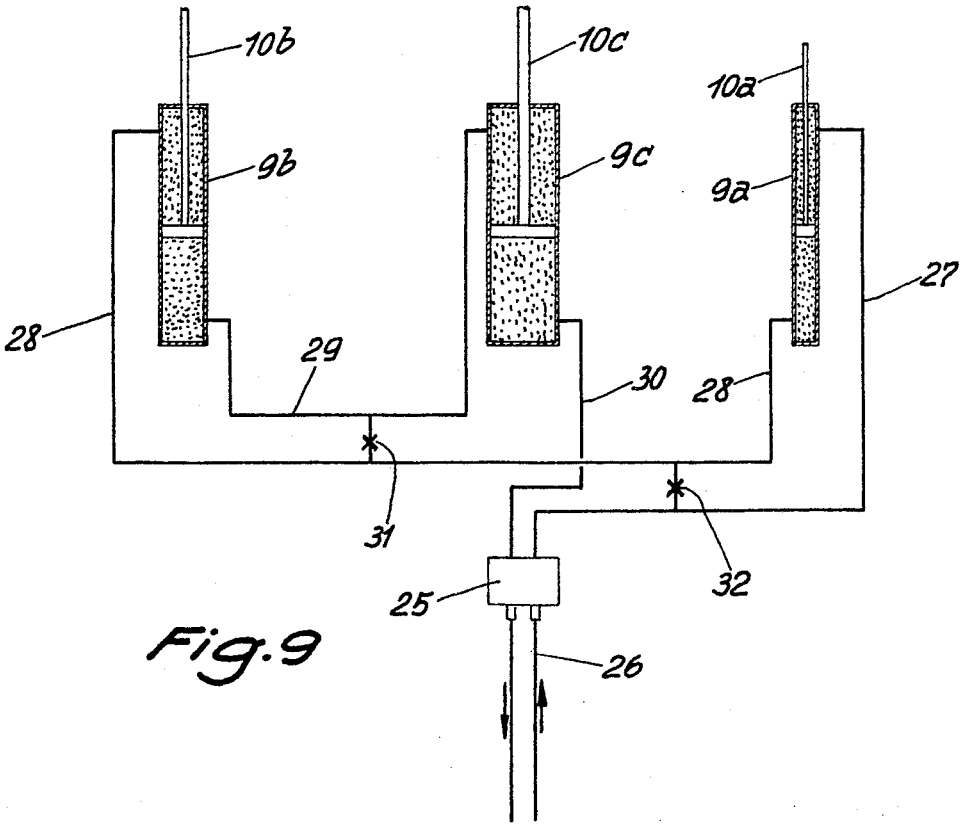

A constructional form of the object of the invention is illustrated by way of example in the drawings, in which:

FIG. 1 shows a lateral view of the apparatus, with the planing bodies in the position for levelling, FIG. 2 shows the arrangement of the hydraulic driving device on the vehicle supports and the guideways thereof, FIG. 3 shows a lateral view of the apparatus in the position in which the planning bodies break the blanket of snow, FIG. 4 shows a lateral view of a planing body on an enlarged scale, FIG. 5 shows a horizontal section through the upper part of the planing body along the line V—V in FIG. 4, FIG. 6 shows a view of the apparatus from the rear in the direction of the arrow VI in FIG. 3, FIG. 7 shows a top view of FIG. 1, FIG. 8 shows a top view of the draw frame parts in separated positions, and FIG. 9 shows a diagrammatical representation of an exemplified arrangement of the lifting cylinders.

The apparatus for the preparation of skiing courses shown in FIG. 7 comprises a draw mounting frame 1, which is composed of two angular parts, whose angular legs 1' extending in the direction of travel are connected by hinges 2, so that the angular legs 1" shown in FIG. 6 and extending transversely to the direction of travel can be swivelled relative to one another in the direction of the arrows *a* or *b* and allow an adaptation to the unevenness in the blanket of snow D. The draw shaft 3 is connected to the front ends of the frame legs 1' extending in the direction of travel. Diagonal members of the angular frame parts 1, by means of which the tensile stress capacity of the latter is increased, are designated by 4. On the transversely extending frame legs 1" of the mounting frame 1, there are fastened vertically extending slides 5, which are formed from square tubes and which are slidably guided on supports 6.

Runners 8, comprising longitudinal track laminae 8' (FIG. 6) arranged on the underside thereof, are hinged by means of joints 7 to the lower ends of the supports 6. Hydraulic driving devices 9.10, whose cylinders 9 are connected to the slides 5 and whose piston rods 10 are connected to the upper ends of the supports 6, serve for the vertical adjustment of the draw mounting frame 1. The hydraulic cylinders 9 are connected by a metal piping system 11 for the delivery and removal of a pressure medium to a valve block which, for its part, is connected by means of hose pipes to a pump or a pressure medium reservoir, whose control device is operable from the driver's seat. As can be seen in FIG. 8, the metal lines 11 are installed in the tubes 1', 1" and 4 of the mounting frame.

Designated by 12 are six planing bodies which run side by side and which are swingably hinged by means of draw rods 12 to bearing forks 14 of the cross legs 1" of the frame parts 1 and which allow, in two groups of three, an adaptation to the unevenness of the blanket of snow by swivelling of the cross legs 1" about the hinges 2. The planing bodies 12 comprise on their underside plane sliding surfaces, which rest flatly on the blanket of snow D when the mounting frame 1 is lifted (FIG. 1). The front end of the planing bodies 12 forms a surface 12' (FIG. 4) which slants towards the front and on which the planing knife 15 is fastened. As shown in FIG. 4, the planing bodies 12 are designed as hollow bodies, whose side walls project to the bottom and form longitudinal track laminae 16. On the upper side of the hollow bodies 12, there are fastened, along the centre thereof (FIG. 5), two vertical bearing plates 17, which extend in the direction of travel, at a distance from and in parallel with one another. The bearing plates 17 are closed by a spline profile rail 18 at their front faces and partially by a flat iron 19 at their rear faces, whereby the parallel position of the bearing plates 17 is additionally secured. A vertically downwardly projecting longitudinal guide plate 20, which engages from the top between the bearing plates 17 of the planing bodies 12, is fastened to each of the rear end parts of the draw rods 13. The bearing plates 17 and the longitudinal guide plate 20 engaging in the latter are penetrated in a bearing bore 21, which passes through the three plates, by a pivot pin 22, about which the planing body 12 can swivel into its position of non-use, which is shown in dash-dotted lines in FIG. 3, in the event of an obstacle blocking its way. Mounted in front of the pivot pin 22 are three smaller bores 23 (FIG. 4), which penetrate the three plates 17, 20 and into which a shearing pin 24 can be optioanlly inserted. In FIGS. 1 and 2, the shearing pin 24 is inserted in the bore 23, which is at a maximum distance from the pivot pin 22, in which position the moment of shearing resistance is greatest. The smaller the distance of the shearing pin from the pivot pin 22, the smaller the moment of resistance to shearing. When the pin 24 has shorn off, a new shearing pin has to be inserted.

For the preparation or regeneration of skiing courses, the draw mounting frame 1 is lowered to the position shown in FIG. 3, with the planing bodies digging into the blanket of snow in the manner of a plough share during travel of the apparatus in the direction of the arrow VI shown in FIG. 3, during which process the blanket of snow is broken and crumbled up over the entire width of the apparatus, Expediently, the apparatus is operated at lower temperatures of the environmental air. The cold air can now penetrate into the gaps between the lumps of snow, which are only loosely joined, thereby causing the blanket of snow to freeze through homogenously in its entire loosened area. Subsequently, it is then possible to produce the hard course blanket by fine levelling and smoothing.

FIG. 9 shows a diagrammatical illustration of the hydraulic driving device, wherein the lifting cylinders, designated by 9*a*, 9*b*, and 9*c*, are connected in series. As in the previous example, the lifting cylinders are connected to the slides 5, while the piston rods 10*a*, 10*b* and 10*c* are again connected to the upper ends of the supports 6. 25 designates the valve block which is operable from the driver's seat and to which the pressure medium flows through the line 26 connected to a pump. From the valve block 25 the pressure medium passes through the line 27 into the cylinder chamber located above the piston of the cylinder 9*a*, during which process the cylinder 9*a* is lifted. The pressure medium disposed beneath the piston of the cylinder 9*a* is displaced during this process and passes through the line 28 into the chamber of the lifting cylinder 9*b* located above the piston, during which process this latter is also lifted. The pressure medium disposed beneath the piston of the cylinder 9*b* is ejected during this process and passes through the line 29 into the chamber of the cylinder 9*c* located above the piston, during which process this cylinder is also lifted. The pressure medium disposed beneath the piston of the cylinder 9*c* flows through the line 30 and the valve block 25 back into a pressure medium reservoir mounted upstream of the pump. The filler necks for the pressure medium are designated by 31 and 32. Since the chamber above the piston of the cylinder 9*a* is smaller than the cylinder volume beneath the piston by the volume of the piston rod, the amount of pressure medium ejected from the cylinder 9*a* is larger than the amount thereof which can flow into the upper cylinder chamber through the line 27. Therefore, each cylinder downstream thereof has to have a capacity that is correspondingly larger, as diagrammatically shown in FIG. 9.

If the draw mounting frame 1 is to be lowered again, then instead of being connected to the pump the line 27 is connected, by a reversal of the valve block 25, to the pressure medium reservoir mounted upstream of the pump. The pressure medium displaced from the upper cylinder chamber during the downward movement of the cylinder 9*a* then flows back into the pressure medium reservoir, while pressure medium is sucked from the upper chamber of the cylinder 9*b* through the line 28 into the cylinder chamber located beneath the piston. At the same time, pressure medium is sucked from the upper chamber of the cylinder 9*c* through the line 29 into the lower chamber of the cylinder 9*b*, the lower chamber of the cylinder 9*c* being supplied with pressure medium from the pressure medium reservoir through the line 30.

I claim:

1. An apparatus for the preparation and regeneration of skiing courses comprising a draw mounting frame, guides mounted on the frame, runners, runner supports, runner hinge, means for mounting the runners on the lower ends of the runner supports, said supports being slidably adjustable up and down in said guides, hydraulic means for adjusting said supports in said guides, planing bodies, draw rods carrying said planing bodies, said draw rods being hinged to said frame, the arrangement being such that said planing bodies can be lowered into the snow in the manner of a plough.

2. An apparatus as claimed in claim 1, characterized in that the draw mounting frame 1 comprises two angular frame parts having legs extending longitudinally and legs extending transversely of the direction of travel, said longitudinal legs being connected by leg hinge means by draw rods so as to allow the draw rods to be swivelled in adaptation to the unevenness of the blanket of snow.

3. An apparatus as claimed in claim 2, characterized by a plurality of bearing forks on said transverse legs, said bearing forks carrying several juxtaposed planing bodies on draw rods respectively hinged to said legs.

4. An apparatus as claimed in claim 2, characterized by plough knives on said planing bodies, the arrangement being such that when the draw frame is lifted, the planing bodies rest, with their plane undersides, flatly on the blanket of snow, thereby enabling a levelling of the course, while when the draw frame is in its lowered position, the planing bodies pentrate into the blanket of snow with their planing knives, which are secured to the forward slanting front ends (12') thereof.

5. An apparatus as claimed in claim 2, characterized in that the angular frame parts are stiffened by diagonal members connecting the longitudinal legs to the transverse legs.

6. An apparatus as claimed in claim 2, characterized in that said guides are fastened to the transverse legs of the mounting frame and said hydraulic means act on said guides and on the upper ends of the supports.

7. An apparatus as claimed in claim 2, wherein said hydraulic means are connected by a metal piping system for the delivery and removal of a pressure medium to a valve block which is connected to a pump or a pressure medium reservoir having a control device operable from the driver's seat.

8. An apparatus as claimed in claim 2, characterized in that said piping is installed in the longitudinal and transverse legs.

9. An apparatus as claimed in claim 2, characterized in that the leg hinge means have a longitudinal axis and six juxtaposed planing bodies are swingably hinged, in two groups of three on opposite sides of saw axes, to the two transverse legs and so as to allow the planing bodies to be adapted transversely to the unevenness of the blanket of snow.

10. An apparatus as clainmed in claim 1, characterized in that the planing bodies are designed as hollow bodies whose side walls project towards the bottom of said bodies and form longitudinal track laminae.

11. An apparatus as claimed in claim 1, characterized in that two vertical bearing plates are secured at a distance from and parallel to one another on the upper side of each planning body, adjacent the central vertical plane of said body, and are connected by an angular rail at the front edges and by a flat strip at the rear edges of said plates, which rail and strip ensure the parallel position of the bearing plates, and in that there is secured to the rear end parts of each of said draw rods a vertically downwardly projecting longitudinal mounting plate, which engages between the bearing plates.

12. An apparatus as claimed in claim 2, characterized in that two vertical bearing plates are secured at a distance from and parallel to one another on the upper side of each planing body, adjacent the central vertical plane of said body, and are connected by an angular rail at the front edges and by a flat strip at the rear edges of said plates, which rail and strip ensure the parallel position of the bearing plates, and in that there is secured to the rear end parts of each of said draw rods a vertically downwardly projecting longitudinal mounting plate, which engages between the bearing plates and the bearing plates and the mounting plates are penetrated by a pivot pin in a bore passing through the three plates and by a shearing pin in at least one further bore, which is mounted forwardly of the pivot pin.

* * * * *